US005320004A

United States Patent [19]

Hsiao

[11] Patent Number: 5,320,004

[45] Date of Patent: Jun. 14, 1994

[54] FOLDING TOOL SET

[76] Inventor: Chia-Yuan Hsiao, No. 4, Lane 11, Tze-Chiang St., Tu-Cheng City, Taipei Hsien, Taiwan

[21] Appl. No.: 124,010

[22] Filed: Sep. 21, 1993

[51] Int. Cl.[5] ..... B25B 23/00

[52] U.S. Cl. ..... 81/440; 81/177.4; 81/177.6

[58] Field of Search ..... 81/437–440, 81/177.4, 490, 177.6; 7/100, 138, 165, 167

[56] References Cited

U.S. PATENT DOCUMENTS 2,804,970 9/1957 Kuc et al. ..... 81/440 X
4,384,499 5/1983 Shockley ..... 81/440
4,836,066 6/1989 Graham et al. ..... 81/440 X

*Primary Examiner*—D. S. Meislin
*Attorney, Agent, or Firm*—Morton J. Rosenberg; David I. Klein

[57] ABSTRACT

A folding tool set includes a handle formed of two opposite oblong cover plates connected by a first screw bolt and a second screw bolt, a set of left-handed tools respectively pivoted about the first screw bolt between the cover plates, a set of right-handed tools respectively pivoted about the second screw bolt between the cover plates, a plurality of oblong spanners made to slide between the cover plates at different elevations and set to cover the sets of left-handed and right-handed tools within the handle, and at least one hexagonal tool bit respectively received within the handle between the set of left-handed tools and the set of right-handed tools.

3 Claims, 8 Drawing Sheets

FOLDING TOOL SET

BACKGROUND OF THE INVENTION

The present invention relates to a folding tool set which is consisted of sets of tools connected together for a variety of applications that can be respectively folded up when not in use.

Various folding tool sets have been disclosed, and have appeared on the market. These tool sets is consisted of a set of tools of different specifications. However, the number of tools is limited, because increasing the number of tools relatively complicates the operation of the folding tool sets or increases its size.

SUMMARY OF THE INVENTION

The present invention provides a folding tool set which combines a big number of tools together for different applications without increasing much size of the folding tool set. According to the preferred embodiment of the present invention, two cover plates are connected together by two screw bolts; a set of left-handed tools and a set of right-handed tools are respectively pivoted about either screw bolt between the cover plate; a plurality of oblong spanners are made to slide between the cover plates at different elevations and set to cover the sets of right-handed and left-handed tools within the handle; at least one hexagonal tool bit is respectively received within the handle between the set of left-handed tools and the set of right-handed tools. This arrangement allows more tools to be combined together without increasing their storage space.

DETAILED DESCRIPTION OF THE PREFERRED EMBODIMENT

Figure 1:
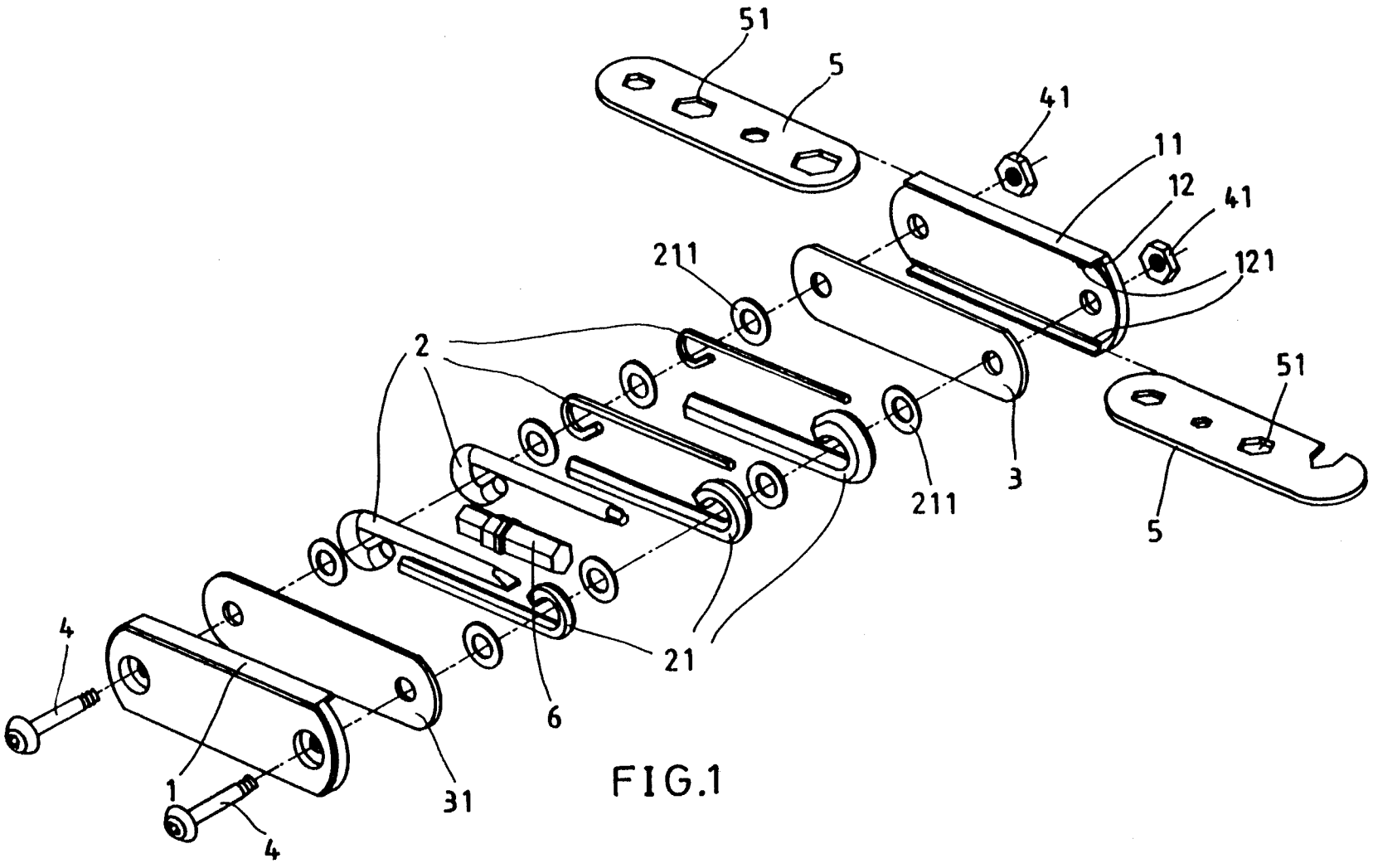
FIG. 1 is an exploded view of a folding tool set according to the preferred embodiment of the present invention.
Figure 2:
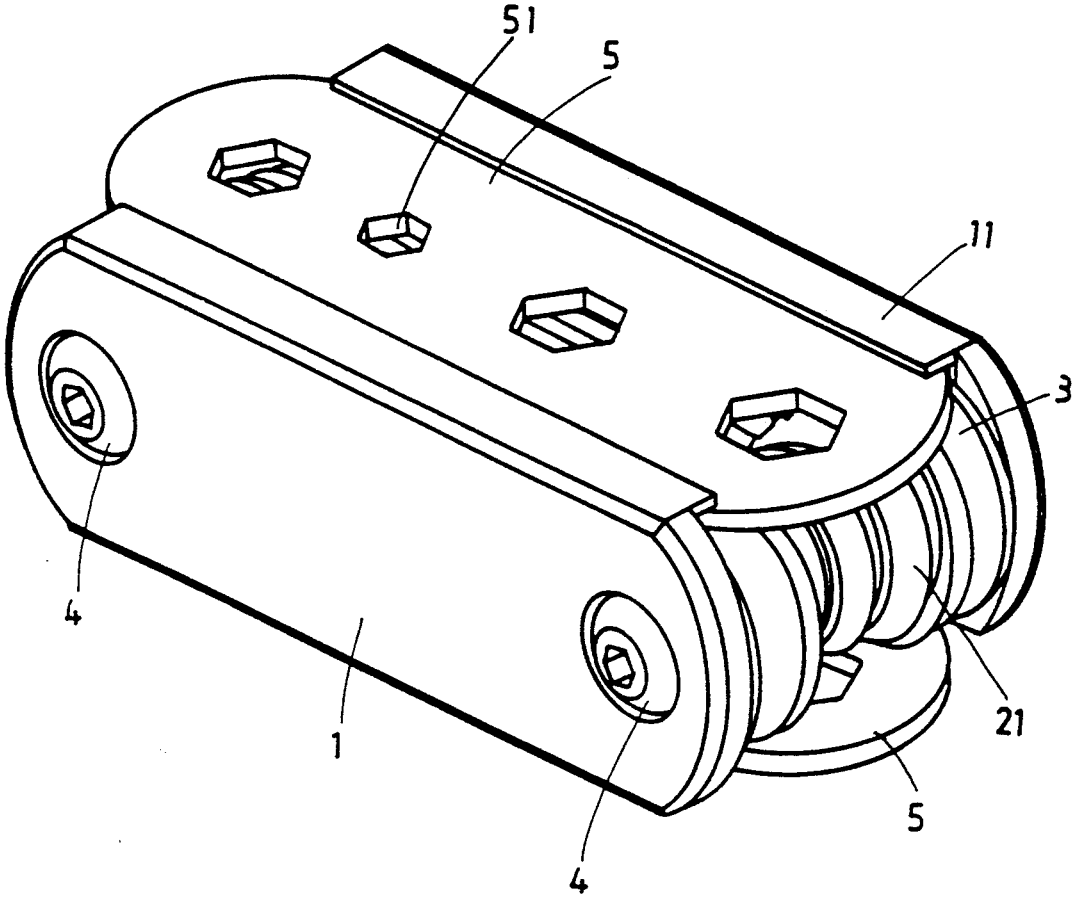
FIG. 2 is an elevational view of the folding tool set shown in FIG. 1.
Figure 3:
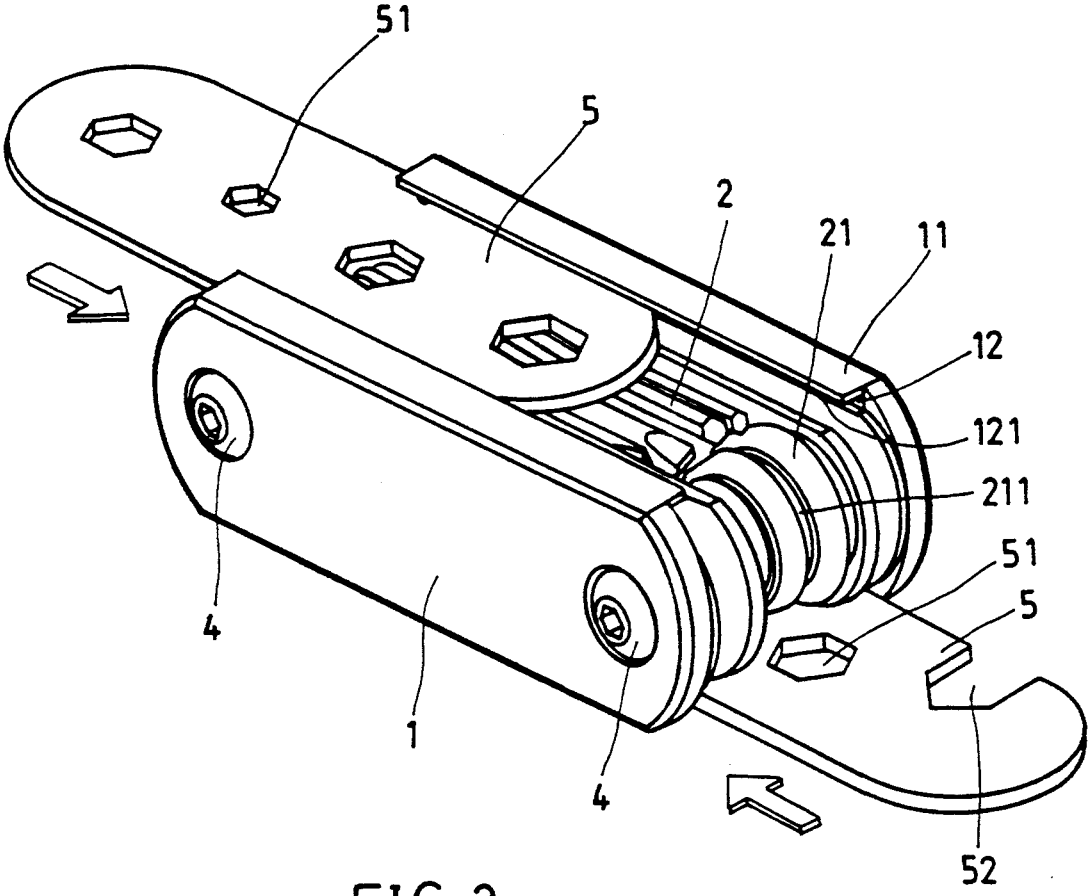
FIG. 3 shows two spanners respectively inserted in between the two cover plates of the folding tool set at two opposite sides.
Figure 4:
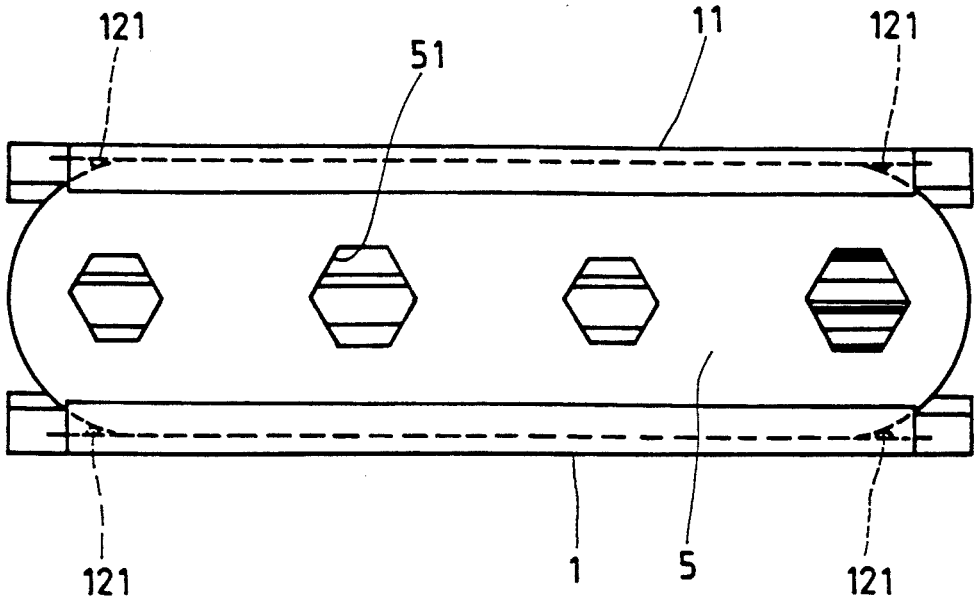
FIG. 4 is a perspective view showing the spanner retained in place by raised portions on the cover plates.

Referring to FIGS. 1, 2, 3, and 4, a folding tool set in accordance with the preferred embodiment of the present invention is generally comprised of a set of left-handed tools 2 and a set of right-handed tools 21 alternatively arranged together and connected between two cover plates 1;11 within two liners 31;3 by screw bolts 4 and nuts 41 and friction rings 211. The left-handed tools 2 and the right-handed tools 21 are respectively separated by the friction rings 211. When assembled, the left-handed tools 2 can be respectively turned outward from right to left on the respective screw bolt; the right-handed tools 21 can be respectively turned outward from left to right on the respective screw bolt; the cover plates 1;11 serve as a handle for the holding of the hand. The cover plates 1;11 are symmetrical, each having two sliding grooves 12 bilaterally disposed along the length. Therefore, two oblong spanners 5 can be inserted between the cover plates 1;11 at different elevations. The spanners 5 have different socket holes 51 and openings 52 for turning different bits, screws, nuts, etc. The cover plates 1;11 further comprise small raised portions 121 respectively disposed on two opposite ends of each sliding groove 12. As either spanner 5 is inserted into either sliding groove 12, its two opposite circular ends become retained in place by the respective raised portions 121. By pushing one end of a spanner 5 to be inserted in between the cover plates 1;11, the circular opposite opposite end of such a spanner 5 immediately passes over the respective raised portions 121. Therefore, the spanners 5 can be firmly and respectively set in between the cover plates 1;11. In the same manner, the spanners 5 can be conveniently removed from the cover plates 1;11.

Figure 5:
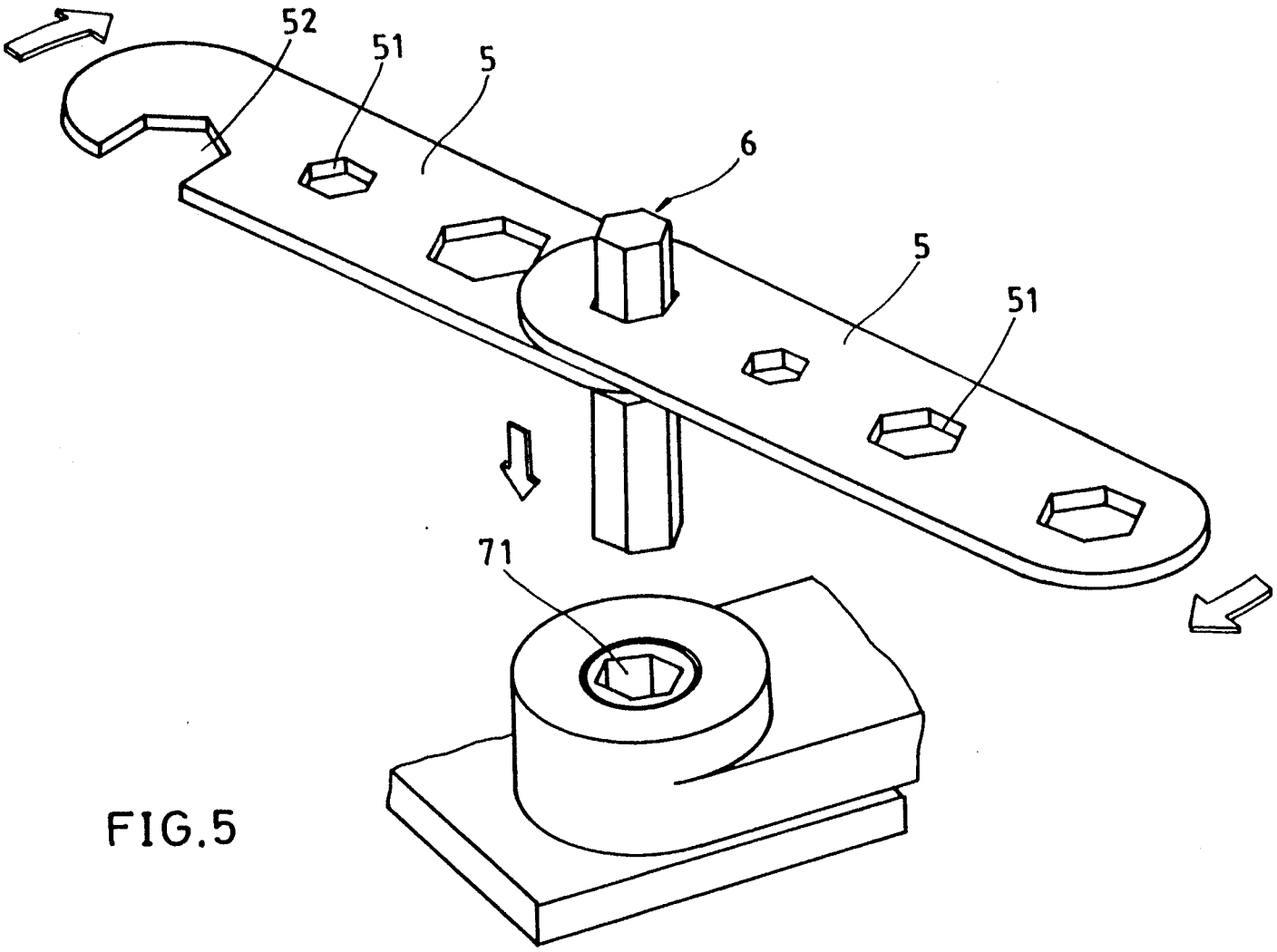
FIG. 5 shows two spanners are longitudinally connected together by a hexagonal tool bit for turning a hexagon socket according to the present invention.
Figure 6:
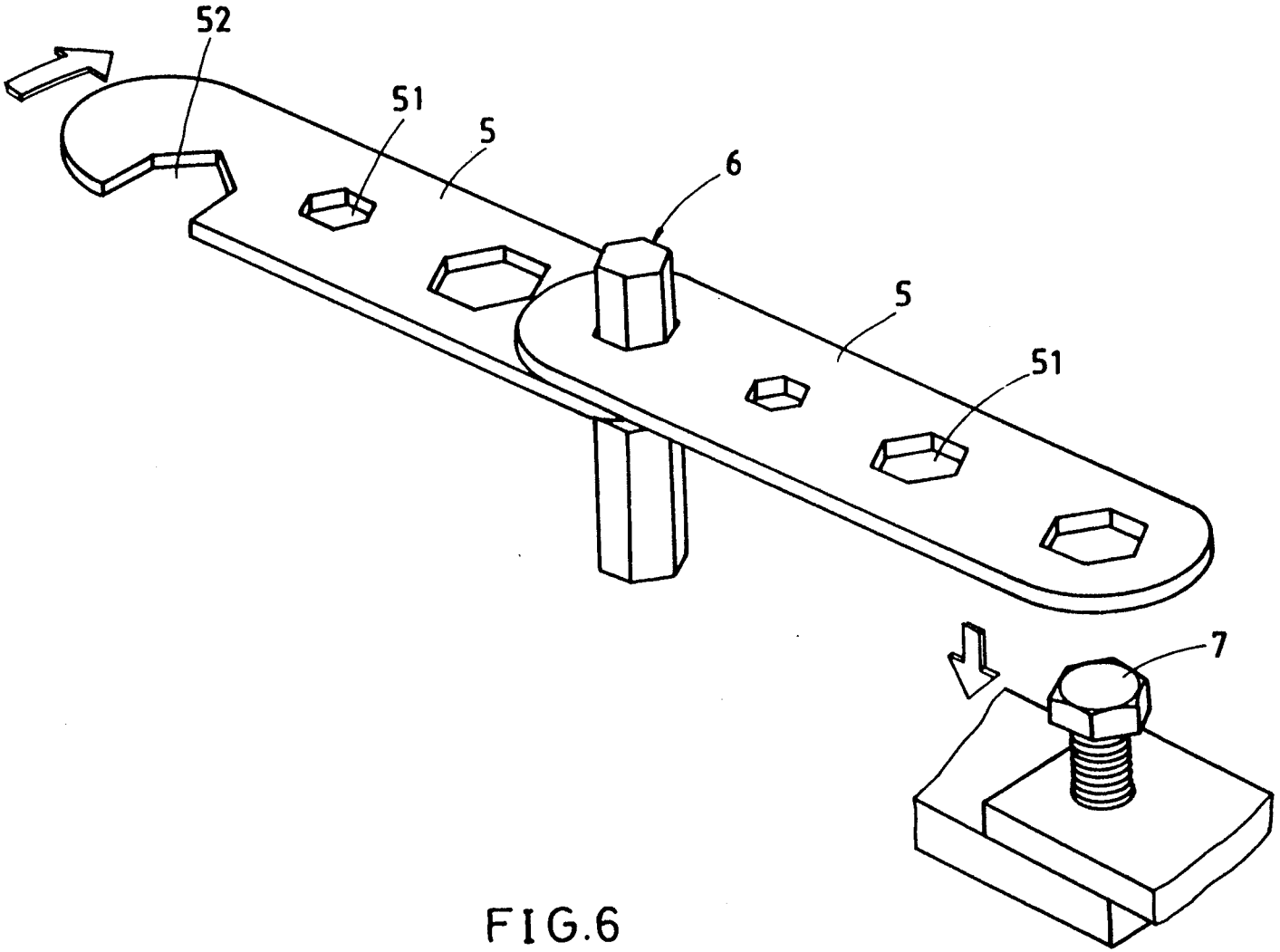
FIG. 6 show two spanners are longitudinally connected together by a hexagonal tool bit for turning a hexagon head bolt according to the present invention.
Figure 7:
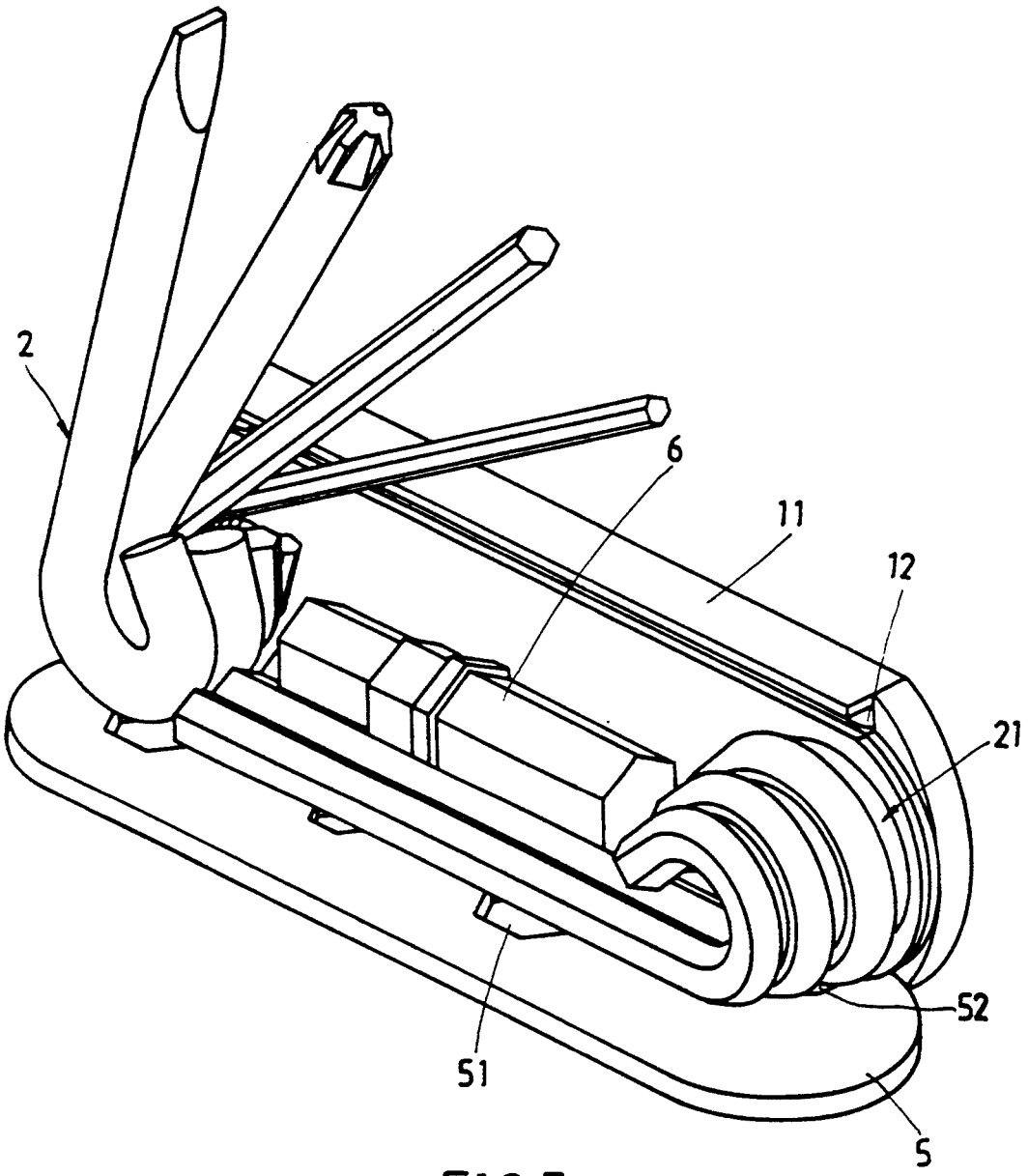
FIG. 7 shows hexagonal tool bit a longitudinally received between the set of right-handed tools and the set of left-handed tools.

Referring to FIGS. 5, 6, and 7, as the set of left-handed tools and the set of right-handed tools 21 are respectively folded up and covered within the two oblong spanners 5, a space is defined in the middle between the set of left-handed tools 2 and the set of right-handed tools 21 for keeping at least one hexagonal tool bit 6. The hexagonal tool bit 6 has two opposite ends made in different sizes, and is used for turning a hexagon socket 71 or the like by the spanners 5. Therefore, the spanners 5 can be longitudinally connected together by the hexagonal tool bit 6 for turning a hexagon socket 71 (see FIG. 5) or a hexagon head bolt 7 (see FIG. 6).

Figure 9:
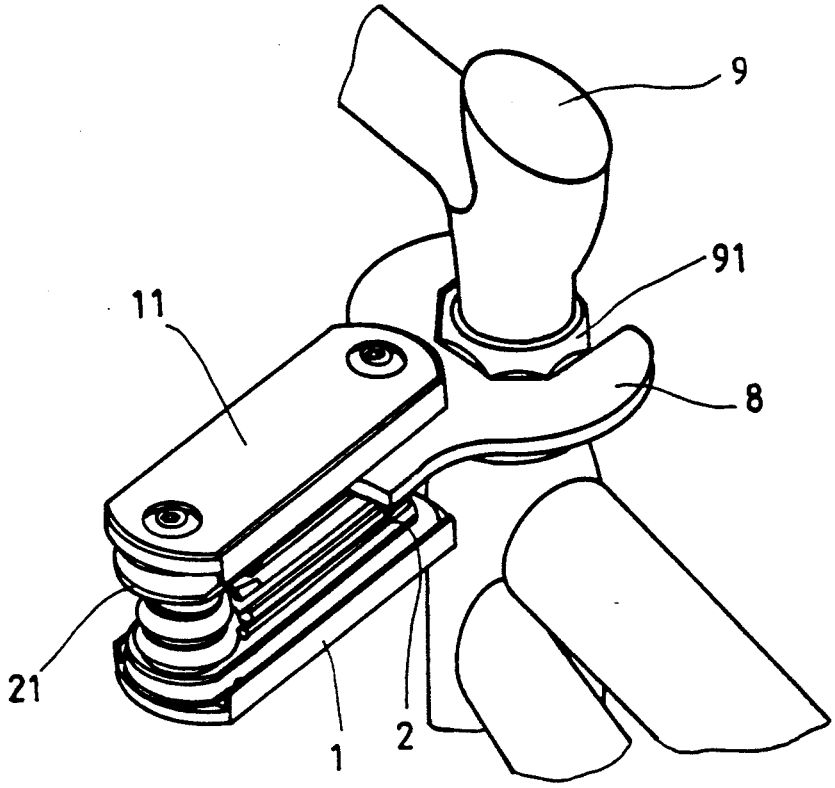
FIG. 9 shows the spanner element driven by the folding tool set to turn the head lock ring of the head tube of a bicycle.
Figure 8:
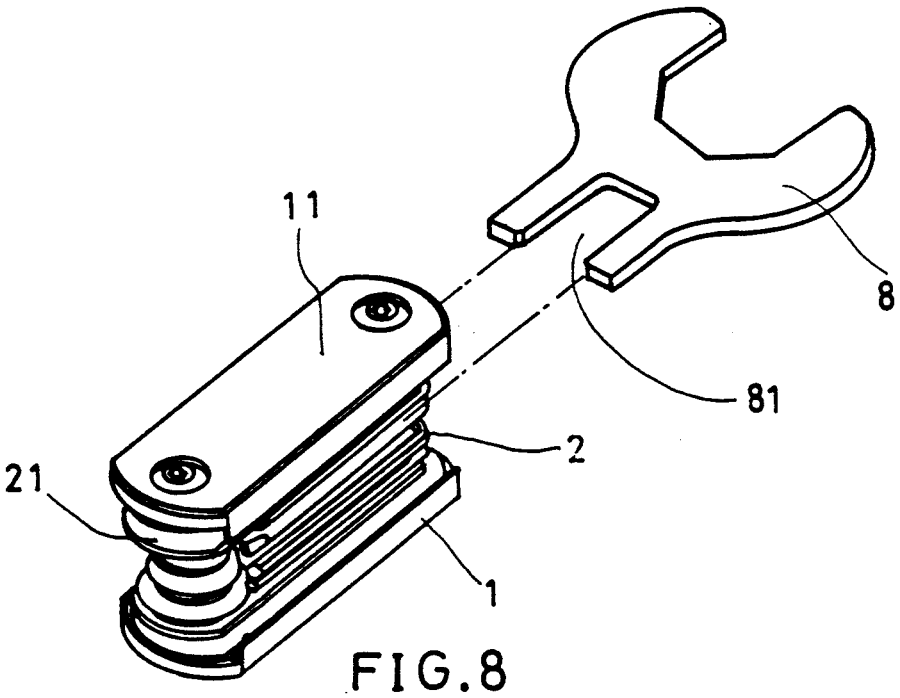
FIG. 8 shows a spanner element for coupling with the folding tool set of the present invention for turning the head lock ring of a head tube of a bicycle

Referring to FIGS. 8 and 9, a spanner element 8 is provided for turning the head lock ring 91 of the head tube 9 of a bicycle by the folding tool set. The spanner element 8 has a rear fork 81 mounted on either screw bolt 4 (after the oblong spanners 5 were removed) and retained in position by the set of left-handed tools 2 and the set of right-handed tools 21. Therefore, the spanner element 8 can be driven by the folding tool set to turn the head lock ring 91.

As indicated, the present invention provides a folding tool set which can be used for turning any of a variety of mechanical parts, and which can be folded up to reduce its storage space when not in use.

What is claimed is:

1. A folding tool set comprising:

a handle formed of two opposite oblong cover plates, said handle comprising a plurality of sliding ways formed between said cover plates at different elevations;

a set of left-handed tools fastened between said cover plates by a first screw bolt and separated from one another by friction rings being mounted around said first screw bolt, the tools of said set of left-handed tools being respectively pivoted about said first screw bolt;

a set of right-handed tools fastened between said cover plates by a second screw bolt and separated from one another by friction rings being mounted around said second screw bolt, the tools of said set of right-handed tools being respectively pivoted about said second screw bolt;

a plurality of oblong spanners made to slide in said sliding ways and set to cover said set of left-handed tools and said set of right-handed tools within said handle, said spanners having different sockets holes and openings for turning hexagon sockets, hexagon head bolts, hexagonal tool bits; and at least one hexagonal tool bit respectively received within said handle between said set of left-handed tools and said set of right-handed tools.

2. The folding tool set of claim 1 wherein said handle comprises small raised portions respectively disposed on said sliding ways at two opposite ends for retaining said oblong spanners in place.

3. The folding tool set of claim 1 further comprising a spanner element having a forked rear end mounted on either screw bolt, after the removable of said oblong spanners from said handle, and retained in position by said set of left-handed tools and said set of right-handed tools and moved for turning the head lock ring of a bicycle's head tube.

* * * * *